US006436555B1

(12) United States Patent
Nakajima et al.

(10) Patent No.: US 6,436,555 B1
(45) Date of Patent: Aug. 20, 2002

(54) ZINC-COMPRISING-PLATED HIGH TENSION STEEL SHEET

(75) Inventors: Seiji Nakajima; Kazuaki Kyono, both of Okayama; Chiaki Kato, Chiba, all of (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/986,295

(22) Filed: Nov. 8, 2001

(30) Foreign Application Priority Data

Nov. 8, 2000 (JP) ..... 2000-340191
Nov. 8, 2000 (JP) ..... 2000-340194

(51) Int. Cl.[7] ..... B32B 15/18

(52) U.S. Cl. ..... 428/659; 134/41; 134/42; 148/902; 428/610

(58) Field of Search ..... 428/659, 610; 148/902; 134/41, 42

(56) References Cited

U.S. PATENT DOCUMENTS 6,342,310 B2 * 1/2002 Hashimoto et al. ..... 428/659

FOREIGN PATENT DOCUMENTS

| | | |
|---|---|---|
| BE | 828 786 | 9/1975 |
| FR | 2 788 284 | 7/2000 |
| JP | A 4-276057 | 10/1992 |
| JP | A 5-230689 | 9/1993 |
| JP | A 6-88251 | 3/1994 |
| JP | A 8-246121 | 9/1996 |

* cited by examiner

*Primary Examiner*—Robert R. Koehler
(74) *Attorney, Agent, or Firm*—Young & Thompson

(57) ABSTRACT

The high tension steel sheet includes 0.1 wt % or more of silicon and has a zinc-plating layer thereon. When sputtering analysis is performed in the depth direction from the surface of the high tension steel sheet after the zinc-comprising-plating layer is removed by dissolution, a surface-concentrated Si index X defined by the formula, X=(the maximum intensity A of Si on the surface of the high tension steel sheet/the average intensity B of Si in the steel)×the content of Si in the steel sheet on a wt % basis, is 12 or less.

7 Claims, 3 Drawing Sheets

ZINC-COMPRISING-PLATED HIGH TENSION STEEL SHEET

BACKGROUND OF THE INVENTION

1. Field of the Invention

The present invention relates to zinc-comprising-plated high tension steel sheets having superior plating appearance, and more particularly, relates to a hot-dip zinc-comprising-plated high tension steel sheet and a hot-dip zinc-alloy-plated high tension steel sheet having superior plating appearance, and to a high tension steel sheet plated with an zinc-comprising-electroplating layer which has a superior adhesion strength, wherein these high tension steel sheets can be preferably used in the fields of automobiles, construction materials, home appliances, and the like.

2. Description of the Related Art

In recent years, the consumption of high tension steel sheets has been increasing in the fields of automobiles, construction materials, home appliances, and the like. In particular, in the field of automobiles, in order to improve fuel consumption, safety during collisions, and the like, high tension steel sheets have been increasingly demanded. As the high tension steel sheets, steel sheets having compositions containing the elements, such as silicon (Si), manganese (Mn), titanium (Ti), aluminum (Al), and phosphorus (P), may be mentioned (for example, disclosed in Japanese Unexamined Patent Application Publication Nos. 61-291924, 60-17052, Japanese Examined Patent Application Publication Nos. 61-11294, and 63-4899). However, it has been well known that when the content of Si is increased, all compositions mentioned above have Si oxide films formed thereon, and as a result, phosphating treatment cannot be preferably performed and the appearance of the hot-dip zinc plating is degraded. The degradation in the appearance of the hot-dip zinc plating means the generation of so-called bare spots, that is, when hot-dip zinc-plating is performed, some spots on the substrate are not plated with molten zinc. In particular, this phenomenon has been a serious problem in high tension steel sheets containing Si.

In hot-dip zinc-plated high tension steel sheets, the relationship between the plating appearance and the amount of Si oxide film existing between the plating layer and the high tension steel sheet has not been quantitatively studied. As a result, hot-dip zinc-plated high tension steel sheets having superior plating appearance have not been reliably manufactured. Furthermore, particularly in recent years, since light weight automobile bodies and the safety during collisions have been increasingly required, steel sheets containing further increased amounts of Si have been developed, and hence, it becomes more difficult to ensure superior plating appearance when hot-dip zinc-plating of the steel sheets mentioned above is performed.

As described above, concerning a hot-dip zinc-plated high tension steel sheet, the level of the content of the Si oxide film formed between the plating layer and the high tension steel sheet at which a hot-dip zinc-plated high tension steel sheet having superior plating appearance can be obtained has not been known at all. However, a hot-dip zinc-plated high tension steel sheet having further improved plating appearance formed by controlling the amount of this Si oxide film in a predetermined range has been strongly desired.

As described above, it has been already understood that phosphating treatment cannot be preferably performed and the plating appearance of hot-dip zinc-plating is degraded due to the presence of this Si oxide film, and in addition, it has also been known that when zinc-electroplating is performed on a high tension steel sheet, the adhesion strength is decreased due to the presence of this Si oxide film.

Accordingly, in order to remove Si oxide films formed on surfaces, there have been proposed, for example, (1) a method of pickling a steel sheet while it is being brushed in a pickling step before plating (disclosed in Japanese Unexamined Patent Application Publication No. 61-159590), (2) a method of polishing surfaces of steel sheets, subsequently performing a pickling treatment for 10 seconds or less, and then performing electroplating (disclosed in Japanese Unexamined Patent Application Publication Nos. 5-230689 and 5-320981), and (3) a method of pickling steel sheets for 3 to 15 seconds using sulfuric acid at a concentration of 20 wt % or more, hydrochloric acid at a concentration of 13 wt % or more, or hydrofluoric acid at a concentration of 3 wt % or more (disclosed in Japanese Unexamined Patent Application Publication No. 7-126888).

However, the relationship between the adhesion strength of the plating layer and the amount of the Si oxide film existing at the interface between a zinc-electroplating layer and the high tension steel sheet has not been quantitatively studied. As a result, even when the above methods (1) to (3) are used, a high tension steel sheet provided with a zinc-electroplating layer which has a superior adhesion strength has not been reliably manufactured, and hence, troubles have frequently occurred in actual pressing steps in automobile manufacturers. In addition, particularly in recent years, since light weight automobile bodies and the safety during collisions have been increasingly required, steel sheets containing further increased amounts of Si have been developed. However, even though the above methods (1) to (3) have been used, the adhesion strength obtained by performing zinc electroplating on the steel sheets mentioned above has been frequently rejected.

As described above, concerning a zinc-electroplated high tension steel sheet, the level of the content of the Si oxide film formed between the plating layer and the high tension steel sheet at which a zinc-electroplated high tension steel sheet having superior adhesion strength can be obtained has not been known at all. However, a zinc-electroplated high tension steel sheet having further improved adhesion strength formed by controlling the amount of this Si oxide film in a predetermined range has been strongly desired.

SUMMARY OF THE INVENTION

Accordingly, an object of the present invention is to provide a zinc-comprising-plated high tension steel sheet having superior plating appearance and a high tension steel sheet provided with a zinc-comprising-electroplating layer having a superior adhesion strength by appropriately controlling the content of a Si oxide film at the interface between the plating layer and the high tension steel sheet.

Through detailed research made by the inventors of the present invention on the plating appearances of a hot-dip zinc-comprising-plated high tension steel sheet and a hot-dip zinc-alloy-plated high tension steel sheet, and on the adhesion strength of a zinc-comprising-electroplating layer provided on a high tension steel sheet, it was understood that although Si contained in the steel had an adverse influence on the plating appearances of a hot-dip zinc-comprising-plated high tension steel sheet and a hot-dip zinc-alloy-plated high tension steel sheet, and on the adhesion strength of a zinc-comprising-electroplating layer provided on a high tension steel sheet, the plating appearance and the adhesion strength were not always determined by the content of Si in the steel sheet. It was also understood that, in addition to the Si content, there were various factors which, in combination, influence the plating appearance and the adhesion strength, for example, annealing conditions or pickling conditions performed before annealing had an influence on the plating appearance, and the annealing conditions, the pickling conditions performed before annealing, the presence of a brushing step or a surface polishing step, pre-dipping conditions in a plating solution, or the like had an influence on the adhesion strength.

Accordingly, in order to fully understand the influences of the plurality of factors mentioned above, through research by the inventors of the present invention using various surface analytical methods, it was discovered that the Si contained in a high tension steel sheet was concentrated on the surface thereof in an annealing step before the high tension steel sheet was dipped in a hot-dip zinc-comprising-plating bath; the amount of Si concentrated on the surface of the steel sheet can be decreased by pickling conditions performed before annealing; and the plating appearance was determined by the amount of the concentrated Si which finally remained on the surface. In addition, concerning the zinc-comprising-electroplating, it was also discovered that the amount of Si concentrated on the surface of the steel sheet was decreased by pickling, brushing, surface polishing, predipping in a plating solution before plating, and the like, and the adhesion strength was determined according to the amount of the concentrated Si which finally remained on the surface.

In addition, through intensive research by the inventors of the present invention in order to measure the amount of concentrated Si which remains on the surface of a steel sheet, it was understood that even if sputtering analysis was performed in the depth direction of a high tension steel sheet provided with a hot-dip zinc-comprising-plating layer or a hot-dip zinc-alloy-plating layer, the peaks of the surface-concentrated Si on the steel surface were vague, and that it was difficult to quantitatively measure the amount of the surface-concentrated Si. Accordingly, the inventors of the present invention found that when sputtering analysis in the depth direction was performed after the hot-dip zinc-comprising-plating layer or the hot-dip zinc-alloy-plating layer was removed by dissolution, an accurate amount of surface-concentrated Si could be quantitatively measured. In addition, it was also found that when the amount of surface-concentrated Si is controlled in a predetermined range, a hot-dip zinc-comprising-plated high tension steel sheet or a hot-dip zinc-alloy-plated high tension steel sheet having significantly superior plating appearance could be obtained, whereby the present invention was made.

Similarly to the above, it was also understood that even if sputtering analysis was performed in the depth direction of a high tension steel sheet provided with a zinc-comprising-electroplating layer thereon, the peaks of the surface-concentrated Si on the steel surface were vague, and that it was difficult to quantitatively measure the amount of the surface-concentrated Si. Furthermore, it was found that when sputtering analysis in the depth direction-was performed after the zinc-comprising-electroplating layer was removed by dissolution, an accurate amount of the surface-concentrated Si could be quantitatively measured. It was also found that when the amount of the surface-concentrated Si is controlled in a predetermined range, a high tension steel sheet provided with a zinc-comprising-electroplating layer having a significantly superior adhesion strength could be obtained, whereby the present invention was made.

In accordance with the understanding described above, the present invention provides a high tension steel sheet comprises 0.1 wt % or more of Si and a zinc-comprising-plating layer provided on the high tension steel sheet, wherein the high tension steel sheet has a surface-concentrated Si index X, defined by the formula below, of 12 or less when a sputtering analysis is performed in the depth direction from the surface of the high tension steel sheet after the zinc-comprising-plating layer is removed by dissolution:

X=(the maximum intensity A of Si on the surface of the high tension steel sheet/the average intensity B of Si in the steel sheet)×the content of Si in the steel sheet on a wt % basis.

In the high tension steel sheet according to the present invention, the zinc-comprising-plating layer provided on the high tension steel sheet may be a zinc-comprising-electroplating layer. The zinc-comprising-electroplating layer provided on the high tension steel sheet has a superior adhesion strength.

In addition, in the high tension steel sheet according to the present invention, it is preferable that the zinc-comprising-plating layer provided thereon be a hot-dip zinc-plating layer, and the high tension steel sheet have a surface-concentrated Si index X of 10 or less according to the formula described above. Consequently, a hot-dip zinc-plated high tension steel sheet having superior plating appearance can be obtained.

Furthermore, in the high tension steel sheet according to the present invention, it is preferable that the zinc-comprising-plating layer provided thereon be a hot-dip zinc-alloy-plating layer, and the high tension steel sheet have a surface-concentrated Si index X of 6 or less according to the formula described above. Consequently, a hot-dip zinc-alloy-plated high tension steel sheet having superior plating appearance can be obtained.

DESCRIPTION OF THE PREFERRED EMBODIMENTS

Hereinafter, the present invention will be described in detail.

In the present invention, the depth direction is the direction perpendicular to the surface of a high tension steel sheet, which is obtained by removing a hot-dip zinc-comprising-plating layer, a hot-dip zinc-alloy-plating layer, or a zinc-comprising-electroplating layer by dissolution. The sputtering analysis is an analytical method which sequentially measures atoms such as Fe or Si or secondary ions emitted from the high tension steel sheet by using a spectroscopic analytical method, a mass spectroscopic analytical method, or the like while the surface of the steel sheet is being slowly excavated by bombardment with ions. Accordingly, in general, the intensities of each element such as Fe or Si thus measured are plotted with sputtering time which means the depth of the high tension steel sheet from the surface thereof, and hence, the distribution of each element in the depth direction of the steel sheet, that is, the profile in the depth direction, can be obtained by drawing a line between the plotted points. In addition, the interface of the plating layer and the steel sheet can be determined by the presence of zinc (Zn) since Zn is not measured in the steel sheet.

In the present invention, as a surface analytical apparatus for performing sputtering analysis in the depth direction of a high tension steel sheet which is obtained by removing a hot-dip zinc-comprising-plating layer, a hot-dip zinc-alloy-plating layer, or a zinc-comprising-electroplating layer, for example, there may be mentioned glow discharge spectroscopy (GDS), secondary ion mass spectroscopy (SIMS), Auger electron spectroscopy (AES), and x-ray photoelectron spectroscopy (XPS) by way of example. Among the analytical methods mentioned above, a GDS method is most preferably used since the sensitivity is superior when sputtering analysis is performed in the depth direction, and the analytical time is also short.

Figure 1:
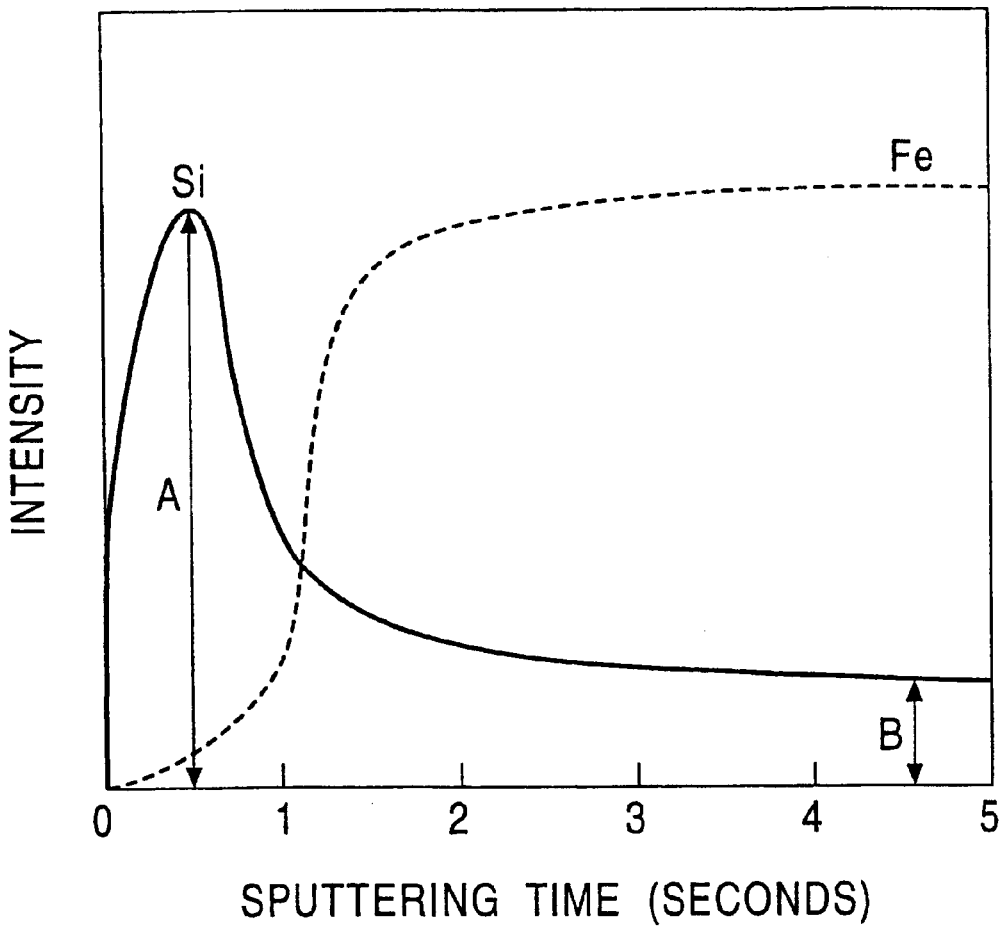
FIG. 1 is a view showing a GDS profile in the depth direction which is obtained by sputtering analysis using GDS performed in the depth direction of a high tension steel sheet according to the present invention after a hot-dip zinc-plating layer provided thereon is removed by dissolution.

In addition, in the present invention, the surface-concentrated Si index X is the value obtained by the formula, X=(the maximum intensity A of Si on the surface of a high tension steel sheet/the average intensity B of Si in the steel sheet)×the content of Si in the steel sheet, in which the maximum intensity A is measured by sputtering analysis in the depth direction of the high tension steel sheet which is obtained by removing a hot-dip zinc-comprising-plating layer, a hot-dip zinc-alloy-plating layer, or a zinc-comprising-electroplating layer, and the average intensity B is also measured in the steel sheet by sputtering analysis. The average Si intensity B means the convergent intensity of Si in the steel sheet. For example, one example of the GDS depth profiles is shown in FIG. 1 which is obtained by performing sputtering analysis using GDS (DGLS-5017 manufactured by Shimadzu Corp.) at an argon flow rate of 500 ml/minute and at a discharge current of 20 mA in the depth direction of a high tension steel sheet obtained by removing a hot-dip zinc-comprising-plating layer provided thereon by the method described below. In addition, concerning a hot-dip zinc-alloy-plated steel sheet, the result of the GDS depth profile obtained in a manner as described above is shown in FIG. 2. Concerning a zinc-comprising-electroplated steel sheet, the result of the GDS depth profile obtained in a manner as described above is shown in FIG. 3.

Figure 2:
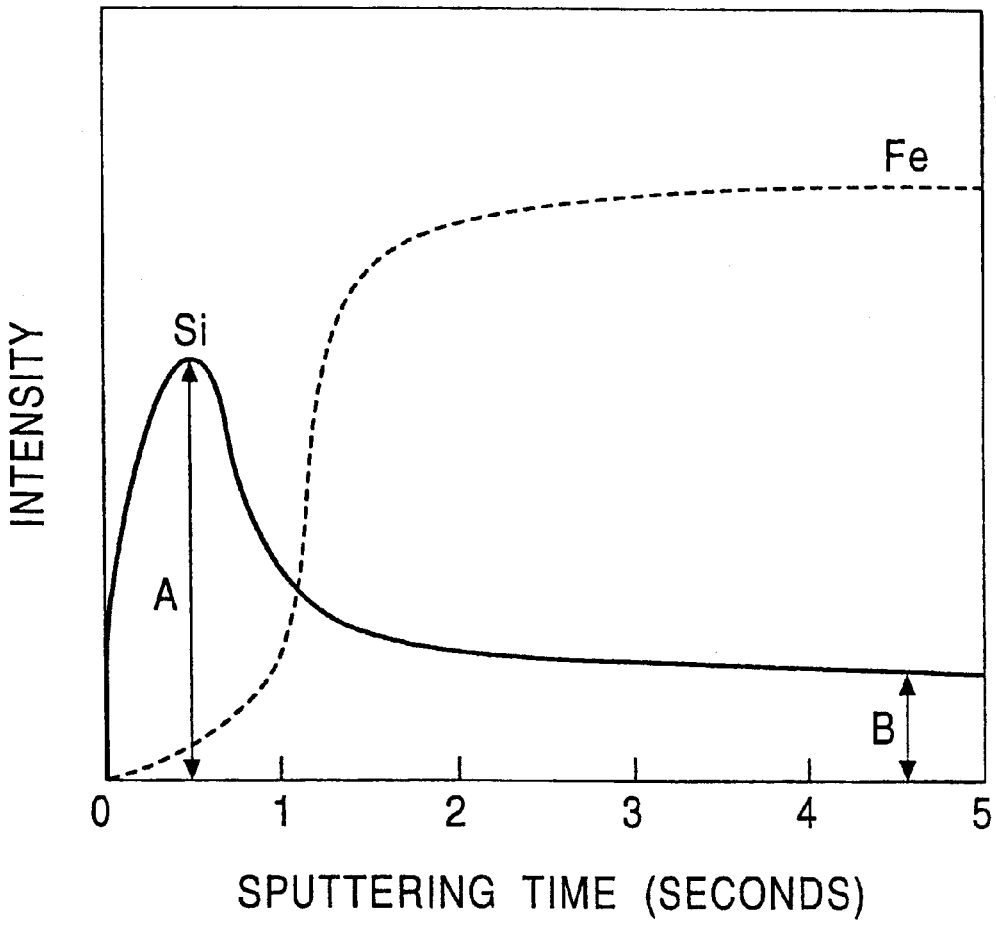
FIG. 2 is a view showing a GDS profile in the depth direction which is obtained by sputtering analysis using GDS performed in the depth direction of a high tension steel sheet according to the present invention after a hot-dip zinc-alloy-plating layer provided thereon is removed by dissolution.
Figure 3:
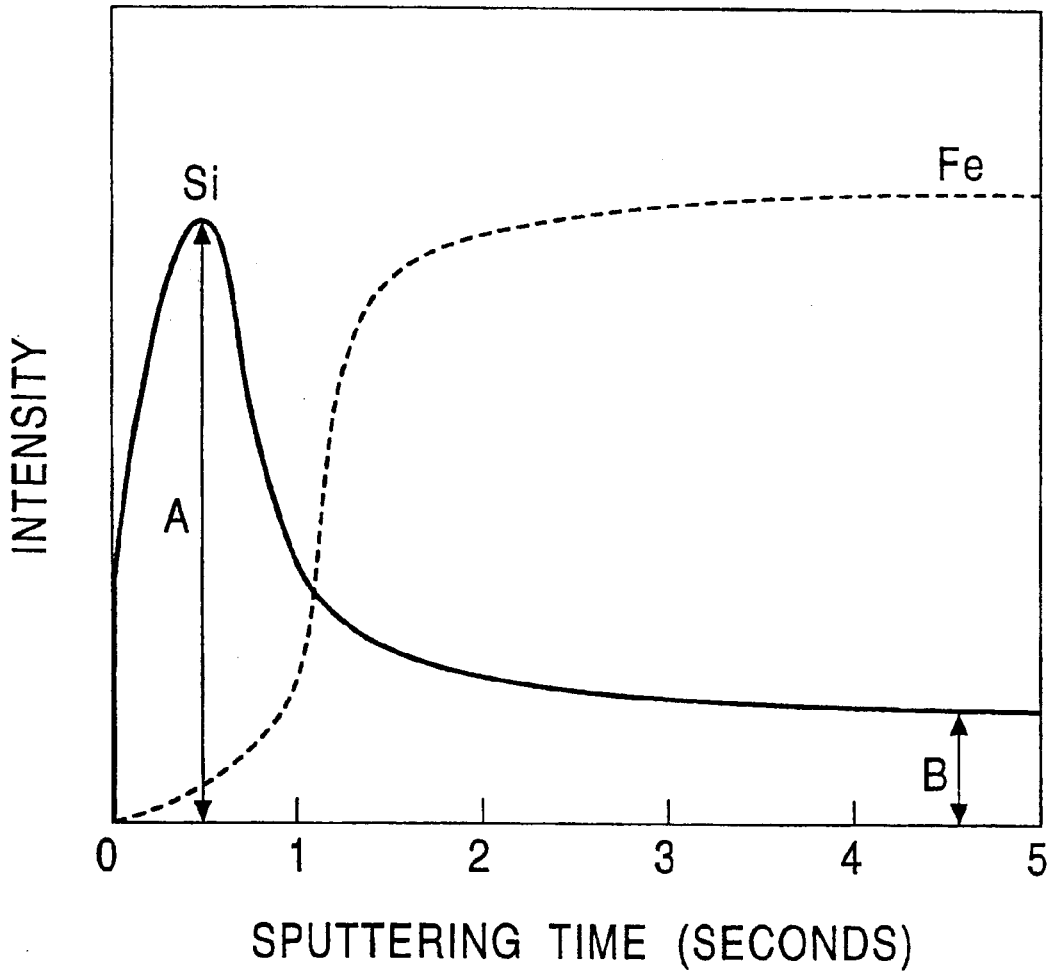
FIG. 3 is a view showing a GDS profile in the depth direction which is obtained by sputtering analysis using GDS performed in the depth direction of a high tension steel sheet according to the present invention after a zinc-comprising-electroplating layer provided thereon is removed by dissolution.

As can be seen from the profiles shown in FIGS. 1 to 3, peaks generated by the surface-concentrated Si layers can be clearly observed on the surfaces of the high tension steel sheets containing Si obtained by removing the hot-dip zinc-comprising-plating, the hot-dip zinc-alloy-plating layer, and the zinc-comprising-electroplating layer by dissolution. When this maximum intensity of Si on the surface is represented by A, and the intensity of Si in the steel is represented by B, the value obtained by the formula, X=(the maximum intensity A of Si on the surface of the high tension steel sheet/the average intensity B of Si in the steel sheet)× the content of Si in the steel sheet, is the surface-concentrated Si index X.

In the present invention, this surface-concentrated Si index X is an index obtained by the ratio A/B, which indicates an increase in Si existing on the steel surface compared to Si contained in the steel, multiplied by the content of Si in the steel, and is the value directly proportional to the total amount of Si existing on the steel surface. Accordingly, by knowing the value of the surface-concentrated Si index X, it becomes possible to know the total amount of Si existing on the steel surface, that is, the quantitative analysis of the total amount of Si existing on the steel surface can be performed.

According to the present invention, the surface-concentrated Si index X of a high tension steel sheet containing Si after a zinc-comprising-plating layer provided thereon is removed by dissolution is 12 or less, and is preferably 0.1 to 10. Since the total amount of Si existing on the steel surface dominantly determines the adhesion strength of the zinc-comprising-plating layer, when this total amount of Si is quantitatively controlled in a predetermined value, that is, when the surface-concentrated Si index X is controlled in the range of 12 or less, the adhesion strength becomes superior, and when the surface-concentrated Si index X exceeds 12, the adhesion strength increasingly becomes inferior.

In the case in which the plating layer of the zinc-comprising-plated high tension steel sheet described above is a zinc-comprising-electroplating layer, the surface-concentrated Si index X of the high tension steel sheet after removing the zinc-comprising-electroplating layer is also 12 or less, and is preferably 0.1 to 10. Since the total amount of Si existing on the steel surface dominantly determines the adhesion strength of the zinc-comprising-electroplating layer, when this total amount of Si is quantitatively controlled in a predetermined value, that is, when the surface-concentrated Si index X is controlled in the range of 12 or less, the adhesion strength becomes superior, and when the surface-concentrated Si index X exceeds 12, the adhesion strength increasingly becomes inferior.

According to the present invention, when the zinc-comprising-plating layer provided on the high tension steel sheet described above is a hot-dip zinc-comprising-plating layer, the surface-concentrated Si index X is 10 or less, and is preferably 9 or less. Since the total amount of Si existing on the steel surface dominantly determines the plating appearance of the hot-dip zinc-comprising-plated high tension steel sheet, when this total amount of Si is quantitatively controlled in a predetermined value, that is, when the surface-concentrated Si index X is controlled in the range of 10 or less, the plating appearance becomes superior, and when the surface-concentrated Si index X exceeds 10, the plating appearance increasingly becomes inferior.

According to the present invention, when the zinc-comprising-comprising-plating film provided on the high tension steel sheet described above is a hot-dip zinc-alloy-plating layer, the surface-concentrated Si index X is 6 or less, and is preferably 5 or less. In the case of the hot-dip zinc-alloy-plated high tension steel sheet, since the counter diffusion of zinc in the hot-dip zinc-comprising-plating layer and iron in the steel sheet is induced by an alloying treatment, the amount of Si on the surface of the steel sheet measured by a sputtering analysis is smaller compared to the case of the hot-dip zinc-plated high tension steel sheet which is not processed by an alloying treatment. However, in the case of the hot-dip zinc-alloy-plated high tension steel sheet, since the plating appearance is also dominantly determined by the surface-concentrated Si index X, when the surface-concentrated Si index X is controlled in the range of 6 or less, the plating appearance becomes superior, and when the surface-concentrated Si index X exceeds 6, the plating appearance increasingly becomes inferior.

The high tension steel sheet used in the present invention, which is a high tension steel sheet used as a substrate to be plated, is a steel containing 0.1 wt % or more of Si. When a steel sheet containing less than 0.1 wt % of Si is used, the degradation of adhesion strength of a plating layer is small. As long as a steel contains 0.1 wt % or more of Si, any known high tension steel sheet can be used, and a high tension steel sheet containing C, Mn, P, S, Al, Ti, Nb, Cr, Mo, B, O, N, or the like according to the desired strength or property may also be used. However, when the content of Si is more than 2.0 wt %, the surface concentration of $SiO_2$ is increased, and it becomes difficult to ensure the adhesion strength of a plating layer, whereby the upper limit of the content of Si is preferably 2.0 wt % or less.

Since high tension steel sheets have been widely used for automobile applications, in view of workability and production cost, the high tension steel sheet preferably contains 0.05 to 0.25 wt % of C, 0.5 to 3.5 wt % of Mn, 0.001 to 0.20 wt % of P, 0.0001 to 0.01 wt % of S, 0.01 to 1.0 wt % of Al, 0.1 wt % or less of Ti, 0.1 wt % or less of Nb, 1.0 wt % or less of Cr, 1.0 wt % or less of Mo, and 0.001 to 0.005 wt % of B.

In the case of the high tension steel sheet which contains 0.1 wt % or more Si and which is provided with the zinc-comprising-plating layer thereon, the zinc-comprising-plating layer provided on the surface of the high tension steel sheet is not specifically limited as long as it primarily contains zinc, and any type of known zinc-comprising-plating layer may be used. For example, there may be mentioned a zinc-comprising-electroplating layer, a vapor zinc-comprising-plating layer, an electroless zinc-comprising-plating layer, a hot-dip zinc-comprising-plating layer, a zinc-alloy-plating layer composed of Fe, Ni, Co, Mo, or the like contained in the plating layers mentioned above, and a zinc-comprising-plating layer composed of an inorganic or an organic material dispersed or co-precipitated in the zinc-plating layers mentioned above.

In the case of the high tension steel sheet provided with the zinc-comprising-electroplating layer thereon, the zinc-comprising-electroplating layer is not specifically limited as long as it primarily contains zinc, and any type of known zinc-comprising-electroplating layer may be used. For example, there may be mentioned a pure zinc-electroplating layer, a zinc-alloy-plating layer containing Fe, Ni, Co, Mo, or the like, and a zinc composite-electroplating layer composed of an inorganic or an organic material dispersed or co-precipitated in the zinc-comprising-electroplating films mentioned above.

In the case of the high tension steel sheet provided with the hot-dip zinc-comprising-plating layer thereon, the hot-dip zinc-comprising-plating layer is not specifically limited as long as it primarily contains zinc, and any type of known hot-dip zinc-comprising-plating layer may be used. For example, a hot-dip zinc-plating layer, a 5%-aluminum/zinc-alloy-plating layer, a 55%-aluminum/zinc-alloy-plating layer, a zinc-aluminum-magnesium alloy-plating layer, a zinc-aluminum-magnesium-silicon alloy-plating layer may be mentioned, and in addition to the additive elements Al, Mg, and Si mentioned above, the hot-dip zinc-plating layer may contain Pb, Bi, Sb, Ni, Cr, Fe, or the like depending on the desired properties.

In the case of the high tension steel sheet provided with the hot-dip zinc-alloy-plating layer thereon, the hot-dip zinc-alloy-plating layer is not specifically limited as long as it primarily contains zinc, and any type of known hot-dip zinc-alloy-plating layer may be used. In addition, a zinc-iron alloy layer formed by performing an alloying treatment for a hot-dip zinc-comprising-plating layer by heating may also be used. Furthermore, Al, Mg, Si, Pb, Bi, Sb, Ni, Cr, Fe, or the like may be contained in the plating layer according to the desired properties.

In the steel sheets described above according to the present invention, the amounts of the zinc-comprising-plating layer, the hot-dip zinc-plating layer, the hot-dip zinc-alloy-plating layer, or the zinc-comprising-electroplating layer provided on the steel sheets are not specifically limited and may be optionally determined depending on the desired corrosion resistances. In general, an amount of less than 1 $g/m^2$ does not impart sufficient corrosion resistance, and an amount of more than 120 $g/m^2$ increases the production cost, whereby an amount of 1 to 120 $g/m^2$ is preferable.

In order to further improve corrosion resistance, workability, and the like, on the zinc-comprising-plating layer, the hot-dip zinc-comprising-plating layer, the hot-dip zinc-alloy-plating layer, or the zinc-comprising-electroplating layer, another plating layer, a phosphating treated film, a chromate film, an organic resin film, or the like may be provided alone or in combination.

In the present invention, when the surface-concentrated Si index X is obtained by a sputtering analysis, a method for removing the plating layers from the steel sheets described above by dissolution is not specifically limited as long as the plating layers are removed from the sheet surface by dissolution. For example, there may be mentioned a method of using an alkaline aqueous solution containing sodium hydroxide, potassium hydroxide, or the like, or a method of using an acid, such as hydrochloric acid, sulfuric acid, or the like. Among the methods mentioned above, the method of using an alkaline aqueous solution for dissolving the plating layer is a preferable method since the alkaline aqueous solution dissolves a small amount of the surface-concentrated Si layer and has favorable compatibility with the plating appearance. In particular, as a preferable alkaline aqueous solution which substantially does not dissolve the surface-concentrated Si layer, for example, there may be mentioned an aqueous solution composed of 40 to 120 ml of a sodium hydroxide aqueous solution at a concentration of 20%, 0 to 80 ml of a triethanolamine aqueous solution at a concentration of 10%, 0 to 14 ml of a hydrogen peroxide aqueous solution at a concentration of 35%, and 40 to 120 ml of water. In addition, as the most preferable alkaline aqueous solution, there may be mentioned an aqueous solution composed of 80 ml of a sodium hydroxide aqueous solution at a concentration of 20%, 40 ml of a triethanolamine aqueous solution at a concentration of 10%, 7 ml of a hydrogen peroxide aqueous solution at a concentration of 35%, and 75 ml of water.

According to the present invention, a method for adjusting the surface condition of a high tension steel sheet to be plated is not specifically limited so that the surface-concentrated Si index X of the high tension steel sheet measured after removing a zinc-comprising-plating layer or a zinc-comprising-electroplating layer by dissolution is 12 or less; however, various methods may be used in a pickling step performed immediately before a zinc-comprising-electroplating step, and for example, a method of adjusting the surface condition by a flow rate of a pickling solution itself while the pickling solution is forcibly moved in the direction opposite to the moving direction of the steel sheet; a method of increasing the concentration and the temperature of the pickling solution, a pickling time, and the like; and a method of brushing or polishing the surface of the steel sheet may be used.

Among the methods described above, in the pickling step performed immediately before the zinc-comprising-electroplating step, the method of forcibly moving the pickling solution in the direction opposite to the moving direction of the steel sheet has a superior effect of reducing the surface-concentrated Si index X compared to that obtained by the method of increasing the concentration and the temperature of the pickling solution, the pickling time, and the like. In addition, the method of forcibly moving the pickling solution is preferable since the appearance of the zinc-comprising-electroplated steel sheet becomes uniform, line marks are not formed thereon, and adhesion of foreign materials which may degrade the adhesion strength of the plating layer may not occur.

According to the present invention, a method for adjusting the surface condition of a high tension steel sheet to be plated is not specifically limited so that the surface-concentrated Si index X of the high tension steel sheet measured after removing a hot-dip zinc-comprising-plating layer or a hot-dip zinc-alloy-plating layer by dissolution is 10 or less; however, for example, the surface-concentrated Si after annealing can be decreased by effectively reducing the amount of Si existing on the surface of the steel sheet in a pickling step performed before the annealing step, and various methods, such as a method of adjusting the surface condition by a flow rate of a pickling solution itself while the pickling solution is forcibly moved in the direction opposite to the moving direction of the steel sheet; a method of increasing the concentration and the temperature of the pickling solution, a pickling time, and the like; and a method of brushing or polishing the surface of a steel sheet, may be used. Among the methods described above, in the pickling step performed before the annealing step, the method of forcibly moving the pickling solution in the direction opposite to the moving direction of the steel sheet has a superior effect of reducing the surface-concentrated Si index X compared to that obtained by the method of increasing the concentration and the temperature of the pickling solution, the pickling time, and the like. In addition, the method of forcibly moving the pickling solution is preferable since the plating appearance of the hot-dip zinc-comprising-plated steel sheet or the hot-dip zinc-alloy-plated steel sheet becomes uniform, line marks are not formed thereon, and adhesion of foreign materials which may degrade the plating appearance may not occur.

In the method of adjusting the surface-concentrated Si index X by the flow rate of the pickling solution itself in the pickling step while the pickling solution is forcibly moved in the direction opposite to the moving direction of the steel sheet, the surface-concentrated Si index X can be effectively reduced when the flow rate of the pickling solution itself is set to, for example, 0.5 m/second or more. However, since the surface-concentrated Si index X is the value which also depends on the Si content in the steel, when the content Si in the steel is high, the flow rate of the pickling solution must be further increased, and when the Si content is low in the steel, the surface-concentrated Si index X of a hot-dip zinc-comprising-plated steel sheet and that of a hot-dip zinc-alloy-plated steel sheet may be decreased to 10 or less and 6 or less, respectively, in some cases at a flow rate of 0.5 m/second or less.

According to the present invention, a method for performing hot-dip zinc-comprising-plating of a high tension steel sheet and a method for performing an alloy treatment are not specifically limited at all, and any type of known method may be used. As a plating solution, a solution primarily containing zinc is used, and when necessary, Al, Mg, Si, Pb, Bi, Sb, Ni, Cr, Fe, or the like may be added. The temperature of the plating solution is not specifically limited, and a known condition, that is, a temperature of 440 to 490° C., may be used. In addition, an alloying temperature and an alloying time may be set in accordance with know conditions.

According to the present invention, a method for performing zinc-comprising-electroplating of a high tension steel sheet is not specifically limited at all, and any type of known zinc-electroplating method may be used. As a plating solution, a solution containing sulfuric acid, a chloride, or the like may be used; when pure zinc-electroplating is performed, a plating solution primarily contains zinc ions may be used; and when zinc-alloy-plating is performed, an alloying element, such as Fe, Ni, Co, Mo, or the like may be added to the plating solution. In addition, when necessary, an auxiliary conductive agent, such as Na, K, or Al, an organic compound, or an inorganic compound may be added to the plating solution. The temperature and pH of the plating solution, a plating current density, and the like are not specifically limited, and known conditions, for example, a bath temperature of 30 to 70° C., pH of 1 to 5, and a current density of 10 to 200 A/dm$^2$, may be used.

EXAMPLES

Hereinafter, the present invention will be described in particular with reference to examples.

As a steel sheet to be plated by a hot-dip zinc-comprising-plating layer and a hot-dip zinc alloy-plating layer, high tension steel sheets containing 0.08 to 0.16 wt % of C, 1.5 to 2.3 wt % of Mn, 0.01 to 0.025 wt % of P, 0.004 to 0.008 wt % of S, 0.03 to 0.2 wt % of Al, 0.005 to 0.04 wt % of Ti, 0.005 to 0.03 wt % of Nb, 0.01 to 0.10 wt % of Cr, 0.01 to 0.15 wt % of Mo, 0.0002 to 0.002 wt % of B, and Si at various contents shown in Table 1 were used. These steel sheets to be plated were processed by electrolytic degreasing, water rinsing, pickling, water rinsing, drying, annealing, and hot-dip zinc plating in that order under the conditions described below, so that hot-dip zinc-plated high tension steel sheets (GI) were formed. In addition, these hot-dip zinc-plated high tension steel sheets were processed by an alloying treatment, so that hot-dip zinc-alloy-plated high tension steel sheets (GA) were formed. Furthermore, by changing the flow rate of the pickling solution, the surface-concentrated Si index X was increased and decreased.

(Electrolytic Degreasing Conditions)

Composition of Degreasing Solution: sodium orthosilicate at a concentration of 30 g/l Bath Temperature: 70° C.

Current Density: 10 A/dm$^2$

Time for current application: 5 seconds (Pickling Conditions)

Composition of Pickling Solution: hydrochloric acid at a concentration of 5%

Bath Temperature: 60° C.

Dipping Time: 6 seconds

Flow Rate: 0 to 1.0 m/second (Annealing Conditions)

Annealing Temperature: 820° C.

Soaking Time: 20 seconds

Hydrogen Concentration: 8%

Dew Point: 40° C.

(Hot-Dip Zinc-Plating Conditions)

Plating Solution: 0.15% of Al, 0.04% of Fe, 0.008% of Pb, and the balance

Bath Temperature: 450° C.

Addition Amount: 60 g/$M^2$ (Thermal Alloying Conditions)

Alloying Temperature: 490° C.

Alloying Time: 15 seconds

As a steel sheet to be plated with a zinc-electroplating layer, high tension steel sheets containing 0.09 to 0.14 wt % of C, 1.1 to 2.5 wt % of Mn, 0.01 to 0.03 wt % of P, 0.005 to 0.007 wt % of S, 0.03 to 0.06 wt % of Al, 0.001 to 0.01 wt % of Ti, 0.002 to 0.02 wt % of Nb, 0.03 to 0.09 wt % of Cr, 0.02 to 0.06 wt % of Mo, 0.0001 to 0.001 wt % of B, and Si at various contents shown in Table 2 were used. These steel sheets to be plated were processed by electrolytic degreasing, water rinsing, pickling, water rinsing, and zinc-electroplating in that order under the conditions described below, so that zinc-electroplated high tension steel sheets were formed. As the zinc-comprising-electroplating, pure zinc-plating, zinc-nickel alloy-plating, or zinc-iron alloy-plating was performed. In addition, by changing the flow rate of the pickling solution, the surface-concentrated Si index X was increased and decreased.

(Electrolytic Degreasing Conditions)

Composition of Degreasing Solution: sodium orthosilicate at a concentration of 30 g/l Bath Temperature: 70° C.

Current Density: 10 A/$dm^2$

Time for current application: 5 seconds (Pickling Conditions)

Composition of Pickling Solution: $H_2SO_4$ at a concentration of 50 g/l

Bath Temperature: 50° C.

Dipping Time: 5 seconds

Flow Rate: 0 to 1.0 m/second (Pure Zinc-Plating Conditions)

Plating Solution: $ZnSO_4.7H_2O$ at a concentration of 350 g/l, and $Na_2SO_4$ at a concentration of 30 g/l pH: 1.5

Bath Temperature: 50° C.

Flow Rate: 1.0 m/second

Current density: 100 A/$dm^2$

Addition Amount: 20 g/$m^2$ (Zinc-Nickel-Alloy-Plating Conditions)

Plating Solution: $ZnSO_4.7H_2O$ at a concentration of 130 g/l, $NiSO_4.6H_2O$ at a concentration of 250 g/l, and $Na_2SO_4$ at a concentration of 40 g/l pH: 1.2

Bath Temperature: 50° C.

Flow Rate: 1.0 m/second

Current density: 80 A/$dm^2$

Addition Amount: 20 g/$m^2$

Ni Content: 12 wt %

(Zinc-Iron-Alloy-Plating Conditions)

Plating Solution: $ZnSO_4.7H_2O$ at a concentration of 210 g/l, and $FeSO_4.7H_2O$ at a concentration of 300 g/l pH: 1.4

Bath Temperature: 50° C.

Flow Rate: 1.0 m/second

Current density. 80 A/$dm^2$

Addition Amount: 20 g/$m^2$

Fe Content: 15 wt %

The plating layers of the hot-dip zinc-plated high tension steel sheet, the hot-dip zinc-alloy-plated high tension steel sheet, and the zinc-comprising-electroplated high tension steel sheet were removed by dissolution by dipping into an aqueous solution composed of 80 ml of a sodium hydroxide aqueous solution at a concentration of 20%, 40 ml of a triethanolamine aqueous solution at a concentration of 10%, 7 ml of a hydrogen peroxide aqueous solution at a concentration of 35%, and 75 ml of water for approximately 30 minutes. Next, after the plating layers were removed, sputtering analysis was performed in the depth directions of the high tension steel sheets by using GDS (GDLS-5017 manufactured by Shimadzu Corp.) at an argon flow rate of 500 ml/minute and a discharge current of 20 mA.

From the profile in the depth direction thus obtained, in a manner equivalent to that shown in FIG. 1, the maximum intensity A of Si on the surface and the average intensity B in the steel were read, whereby the surface-concentrated Si index X was calculated using the formula, X=(the maximum intensity A of Si on the surface of the high tension steel sheet/the average intensity B of Si in the steel sheet)×the content of Si in the steel sheet.

The plating appearance was measured for the hot-dip zinc-plated high tension steel sheet and the hot-dip zinc alloy-plated high tension steel sheet, and was evaluated in accordance with the standard described below by visual inspection.

A: No bare spots generated

B: Generation of a small number of bare spots

C: Generation of a large number of bare spots

In Table 1, the Si content in the high tension steel sheet which was used as the substrate to be plated, plated steel, the flow rate of the pickling solution used for removing the plating layer, the surface-concentrated Si index X thus obtained, and the evaluation result of plating-appearance are shown.

TABLE 1

| No. | Si Content in Steel (wt %) | Flow Rate of Picking Solution (m/sec) | Plated Steel | Surface-Concentrated Si Index X | Plating Appearance |
|---|---|---|---|---|---|
| Example | | | | | |
| 1 | 0.12 | 0.2 | GI | 0.4 | A |
| 2 | 0.12 | 0.6 | GI | 0.2 | A |
| 3 | 0.45 | 0.3 | GI | 2.3 | A |
| 4 | 0.45 | 0.7 | GI | 1.4 | A |
| 5 | 0.92 | 0.2 | GI | 6.5 | A |
| 6 | 0.92 | 0.6 | GI | 3.9 | A |
| 7 | 1.24 | 0.4 | GI | 8.6 | A |
| 8 | 1.24 | 0.8 | GI | 6.0 | A |
| 9 | 1.61 | 0.5 | GI | 9.5 | A |
| 10 | 1.61 | 1.0 | GI | 7.7 | A |
| 11 | 0.12 | 0.3 | GA | 0.2 | A |
| 12 | 0.45 | 0.6 | GA | 1.0 | A |
| 13 | 0.92 | 0.5 | GA | 2.9 | A |
| 14 | 1.24 | 0.6 | GA | 4.2 | A |
| 15 | 1.61 | 0.8 | GA | 5.7 | A |
| Comparative Example | | | | | |
| 16 | 0.45 | 0 | GI | 10.2 | B |
| 17 | 0.92 | 0 | GI | 12.3 | C |
| 18 | 1.24 | 0.2 | GI | 13.7 | C |
| 19 | 1.61 | 0.3 | GI | 15.1 | C |
| 20 | 0.45 | 0 | GA | 6.4 | C |
| 21 | 0.92 | 0 | GA | 8.1 | C |
| 22 | 1.24 | 0.2 | GA | 9.0 | C |
| 23 | 1.61 | 0.2 | GA | 12.1 | C |

As can be seen from Table 1, both the hot-dip zinc-comprising-plated high tension steel sheet and the hot-dip zinc-alloy-plated high tension steel sheet had superior plating appearance.

The zero T bending test was performed for the zinc-comprising-electroplated high tension steel sheet thus formed, and in accordance with the appearances of stripped adhesive tapes, the adhesion strength was evaluated.

Zero T Bending Test

After a zinc-comprising-electroplated high tension steel sheet was folded in half without forming any space therebetween so that the surface for measuring the adhesion strength was outside, and an adhesive tape was adhered to the surface of the bent portion for evaluation, the adhesive tape was stripped, and the adhesion strength was evaluated in accordance with the standard described below by performing visual inspection of the amount of a zinc-plating layer adhered to the adhesive tape.

A: plating layer is not stripped

B: a very small part of plating layer is stripped

C: some parts of plating layer are stripped

D: many parts of plating layer are stripped

In Table 2, the Si content in the high tension steel sheet which was used as the substrate to be plated, type of plating, the flow rate of the pickling solution used for removing the plating layer, the surface-concentrated Si index X thus obtained, and the evaluation result of adhesion strength are shown.

TABLE 2

| No. | Si Content in Steel (wt %) | Flow Rate of Picking Solution (m/sec) | Plating | Surface-Concentrated Si Index X | Adhesion Strength |
|---|---|---|---|---|---|
| Example | | | | | |
| 1 | 0.12 | 0.2 | Zn | 0.4 | A |
| 2 | 0.12 | 0.5 | Zn | 0.2 | A |
| 3 | 0.45 | 0.3 | Zn | 2.4 | A |
| 4 | 0.45 | 0.7 | Zn | 1.5 | A |
| 5 | 0.92 | 0.2 | Zn | 6.8 | A |
| 6 | 0.92 | 0.6 | Zn | 4.0 | A |
| 7 | 1.24 | 0.4 | Zn | 9.6 | A |
| 8 | 1.24 | 0.8 | Zn | 6.5 | A |
| 9 | 1.61 | 0.5 | Zn | 11.6 | B |
| 10 | 1.61 | 1.0 | Zn | 8.2 | A |
| 11 | 0.12 | 0.3 | Zn—Ni | 0.3 | A |
| 12 | 0.45 | 0.6 | Zn—Ni | 1.7 | A |
| 13 | 0.92 | 0.5 | Zn—Ni | 4.9 | A |
| 14 | 1.24 | 0.6 | Zn—Ni | 7.2 | A |
| 15 | 1.61 | 0.8 | Zn—Ni | 10.7 | B |
| 16 | 0.12 | 0.2 | Zn—Fe | 0.4 | A |
| 17 | 0.45 | 0.5 | Zn—Fe | 2.0 | A |
| 18 | 0.92 | 0.6 | Zn—Fe | 4.2 | A |
| 19 | 1.24 | 0.6 | Zn—Fe | 7.5 | A |
| 20 | 1.61 | 0.6 | Zn—Fe | 11.4 | B |
| Comparative Example | | | | | |
| 21 | 0.45 | 0 | Zn | 12.5 | C |
| 22 | 0.92 | 0 | Zn | 14.5 | D |
| 23 | 1.24 | 0.2 | Zn | 15.4 | D |
| 24 | 1.61 | 0.3 | Zn | 17.2 | D |
| 25 | 0.45 | 0 | Zn—Ni | 13.1 | D |
| 26 | 0.92 | 0 | Zn—Ni | 15.0 | D |
| 27 | 1.24 | 0.1 | Zn—Ni | 17.9 | D |
| 28 | 1.61 | 0.4 | Zn—Ni | 16.8 | D |
| 29 | 0.45 | 0 | Zn—Fe | 12.9 | D |
| 30 | 0.92 | 0 | Zn—Fe | 15.1 | D |
| 31 | 1.24 | 0.2 | Zn—Fe | 16.0 | D |
| 32 | 1.61 | 0.2 | Zn—Fe | 20.1 | D |

As can be seen from Table 2, every zinc-comprising-electroplating layer provided on the high tension steel sheet of the present invention showed superior adhesion strength.

The hot-dip zinc-comprising-plated high tension steel sheet and the hot-dip zinc-alloy-plated high tension steel sheet according to the present invention have very superior plating appearance, and the zinc-comprising-electroplated high tension steel sheet according to the present invention has very superior adhesion strength. Accordingly, these zinc-comprising-plated high tension steel sheets described above are significantly valuable materials in the industrial field. In particular, these zinc-plated high tension steel sheets are preferably used in the fields of automobiles, construction materials, home appliances, and the like.

What is claimed is:

1. A high tension steel sheet comprising:

0.1 wt % or more of silicon; and a zinc-comprising-plating layer provided on the high tension steel sheet;

wherein the high tension steel sheet has a surface-concentrated Si index X, defined by the formula below, of 12 or less when sputtering analysis is performed in the depth direction from the surface of the high tension steel sheet after the zinc-comprising-plating layer is removed by dissolution:

X=(the maximum intensity A of Si on the surface of the high tension steel sheet/the average intensity B of Si in the steel)×the Si content in the steel sheet on a wt % basis.

2. The high tension steel sheet according to claim 1, wherein the zinc-comprising-plating layer provided on the high tension steel sheet is a zinc-comprising-electroplating layer.

3. The high tension steel sheet according to claim 2, wherein the surface-concentrated Si index X is 0.1 to 10.

4. The high tension steel sheet according to claim 1, wherein the zinc-comprising-plating layer provided on the high tension steel sheet is a hot-dip zinc-comprising-plating layer, and the surface-concentrated Si index X is 10 or less.

5. The high tension steel sheet according to claim 4, wherein the surface-concentrated Si index X is 9 or less.

6. The high tension steel sheet according to claim 1, wherein the zinc-comprising-plating layer provided on the high tension steel sheet is a hot-dip zinc-alloy-plating layer, and the surface-concentrated Si index X is 6 or less.

7. The high tension steel sheet according to claim 6, wherein the surface-concentrated Si index is 5 or less.

* * * * *